US006199712B1

(12) United States Patent
Rosset

(10) Patent No.: US 6,199,712 B1
(45) Date of Patent: Mar. 13, 2001

(54) MANURE STORAGE CONTAINER

(76) Inventor: Rene Rosset, 28 Braewood Place, Winnipeg, Manitoba (CA), R3R 2T1

( * ) Notice: Subject to any disclaimer, the term of this patent is extended or adjusted under 35 U.S.C. 154(b) by 0 days.

(21) Appl. No.: 09/285,442

(22) Filed: Apr. 2, 1999

Related U.S. Application Data

(60) Provisional application No. 60/110,161, filed on Nov. 27, 1998.

(51) Int. Cl.[7] ..... B65D 25/16

(52) U.S. Cl. ..... 220/495.01; 220/4.16; 220/4.17; 220/565

(58) Field of Search ..... 220/495.01, 495.06, 220/4.16, 4.17, 4.04, 4.07, 4.08, 4.09, 4.12, 475, 565, 567

(56) References Cited

U.S. PATENT DOCUMENTS

| | | | | |
|---|---|---|---|---|
| 2,378,159 | * | 6/1945 | Royer | 220/565 |
| 3,225,362 | * | 12/1965 | Barrera | 220/4.16 |
| 3,409,916 | * | 11/1968 | Billig et al. | 220/495.01 |
| 3,460,705 | * | 8/1969 | Green | 220/4.17 |
| 3,793,786 | * | 2/1974 | Jahnke | 52/157 |
| 3,990,600 | * | 11/1976 | Rossitto et al. | 220/565 |
| 4,240,562 | * | 12/1980 | Holschlag | 220/565 |
| 4,436,214 | * | 3/1984 | Henderson | 220/628 |
| 5,083,327 | * | 1/1992 | Gillebaard | 220/4.16 |
| 5,358,209 | * | 10/1994 | Ward | 248/545 |

* cited by examiner

*Primary Examiner*—Stephen Castellano
(74) *Attorney, Agent, or Firm*—Adrian D. Battison; Murray E. Thrift

(57) ABSTRACT

A liquid storage container primarily for manure or other slurry includes a cylindrical wall formed from a plurality of connected panels of corrugated steel to define a generally horizontal top edge and a generally horizontal bottom edge surrounding an area of ground surface inside the wall. The wall is maintained in vertical orientation by a plurality of vertical posts connected to the wall at spaced positions around the wall. Each post is formed by a channel with the open face outward and an inner face bolted to the wall. Each post is adjustably connected to a respective on e of a plurality of ground anchors each having a vertical shaft and a helical flight on the shaft, the shaft and the flight being arranged to be screwed into the ground, each anchor being connected at its upper end by an adjustable screw to a plate attached across the bottom of the post. An impermeable liner lies over the area of ground surface inside the wall and has a skirt portion attached to the wall.

9 Claims, 7 Drawing Sheets

MANURE STORAGE CONTAINER

This application claims benefit of provisional 60,110,161 filed Nov. 27, 1998.

This invention relates to a liquid storage container of the type suitable for storing large quantities of liquid such as manure in a container which can have an open top.

BACKGROUND OF THE INVENTION

Generally storage containers of this type are formed from a cylindrical wall of corrugated steel which is bolted to a horizontal concrete footing or base. A coating can be applied on the inside surface of the wall and on the concrete base to provide a waterproof layer to prevent escape of the liquid. In alternative arrangements, a liner is applied in the inside of the wall and over the concrete base. It has also been proposed that the footing comprise simply a concrete ring.

However these constructions are relatively expensive particularly in the large size which is necessary for large scale liquid storage suitable for hog plants and the like.

SUMMARY OF THE INVENTION

It is one object of the present invention, therefore, to provide an improved liquid storage container.

According to one aspect of the invention there is provided a liquid storage container comprising:

a cylindrical wall formed from a plurality of connected panels to define a generally horizontal top edge and a generally horizontal bottom edge surrounding an area of ground surface inside the wall;

a plurality of vertical posts connected to the wall at spaced positions around the wall;

a plurality of ground anchors each having a vertical shaft and a helical flight on the shaft, the shaft and the flight being arranged to be screwed into the ground, each anchor being connected at its upper end to a respective one of the posts;

and an impermeable liner lying over the area of ground surface inside the wall and having a skirt portion attached to the wall.

Preferably the wall is formed from corrugated steel panels bolted together and bolted to the posts.

Preferably the skirt portion is attached to the wall by an adhesive sealant material at a position on the wall spaced upwardly from the bottom edge.

Preferably there is provided an attachment band at the upper edge of the skirt portion and bolted to the wall.

Preferably each post has a horizontal plate at the bottom end thereof which is attached to the shaft of the ground anchor.

Preferably the ground anchor includes a screw threaded portion for screw height adjustment of the plate.

Preferably there is provided a reinforcing hoop member connecting the posts at a position adjacent the top edge of the wall.

Preferably there is provided a reinforcing hoop member comprises a tubular member which is attached to each of the posts by a pair of clamps.

Preferably the posts each comprise a channel member having an open face facing outwardly of the wall and an inner face opposite to the open face which is bolted to the wall.

The construction therefore avoids the necessity for any footing of cast concrete or the like and the storage container is applied directly to the ground surface simply by initially excavating the ground surface to a generally horizontal level, by inserting the ground anchors at the required positions around the base of the wall, by levelling the height of the ground anchors by adjustment of a nut on the screw thread portion at the top of the anchor and by applying the posts and wall construction directly to the anchors. The area around the base of the wall can then be backfilled. The liner is applied directly to the ground without the necessity of any concrete base. The bituminous layer on the inside surface of the wall is relatively inexpensive and provides a sealing effect and anti-corrosion effect. The skirt portion of the bottom liner is attached by adhesive and clamping plate to the wall to prevent the escape of the liquid around the outside of the liner.

This construction is therefore relatively simple and therefore relatively inexpensive. The container also can be dismantled and reassembled at a new site without incurring a high assembly cost. Leakage can be readily repaired by simply applying an additional layer of the bituminous coating to a cleaned section of the coating where a leakage is suspected.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
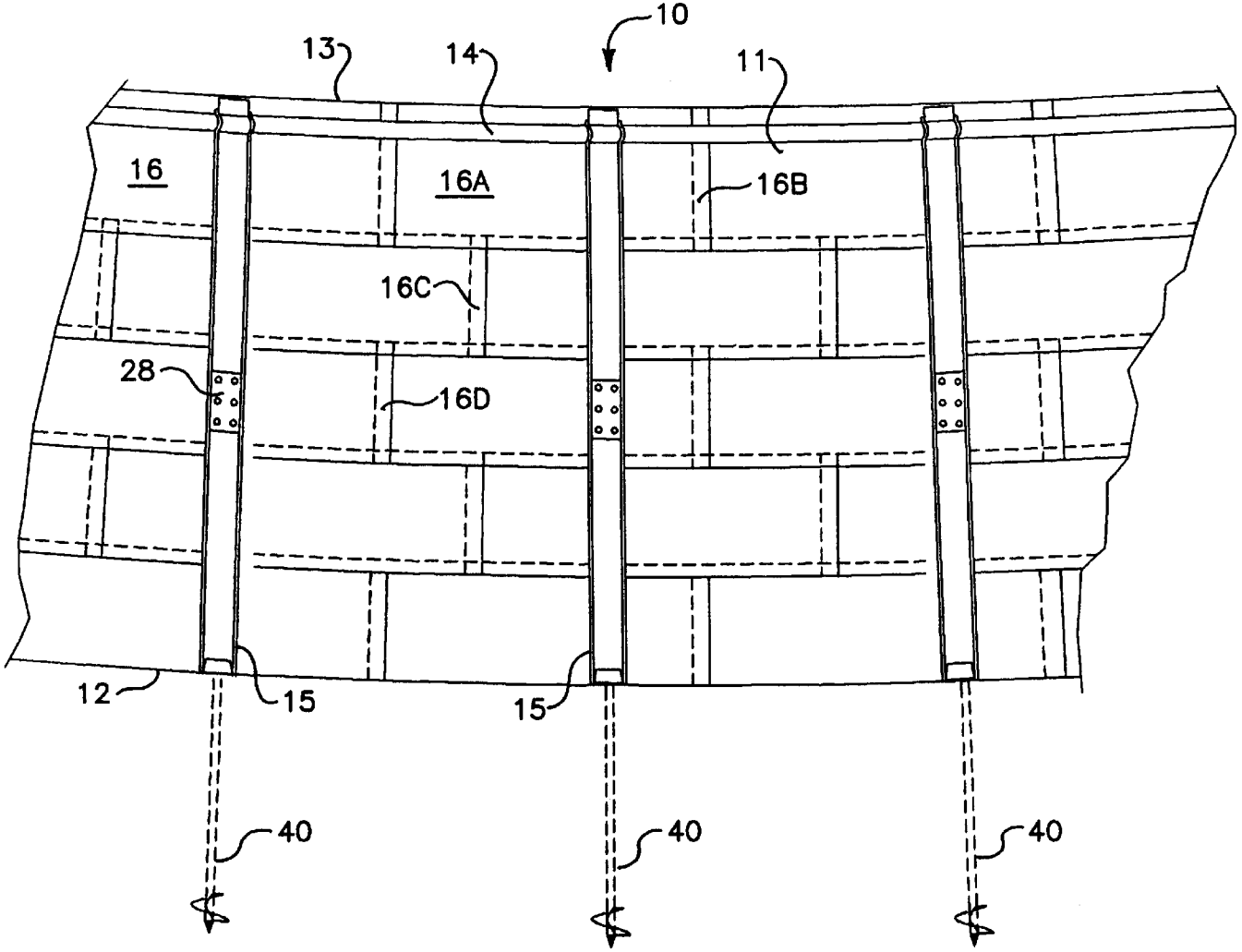
FIG. 1 is an isometric view of one portion of a container according to the present invention.

Turning firstly to FIG. 1 there is shown one section of a containment tank generally indicated at 10 defined by a cylindrical wall 11. The cylindrical wall has a bottom edge 12 at the ground and a top edge 13 spaced from the ground and defining a top of the container. The cylindrical wall is supported by a plurality of vertical posts 15 at spaced positions around the wall together with a top reinforcing hoop member 14 connected to the posts and extending as a continuous around the top edge 13.

The wall itself is formed from a plurality of individual panels 16 of corrugated sheet metal so that it will be treated to prevent corrosion. Each panel 16 is bolted to a next adjacent panel 16A at a lap joint 16B. Thus the top row of panels have a free top edge at the top edge 13 and have a lap joint at each side edge and a further lap joint along the bottom edge.

The lap joint 16B is defined by at least two rows of bolts 17 which clamp the two plates together at the lap joint with a gasket 18 between the two panels at the lap joint. The gasket 18 is formed from a closed cell strip of rubber or other suitable elastomeric material which is adhesively attached to one of the panels. In assembly, therefore, the gasket is provided as a continuous strip having adhesive on one surface with adhesive covered a peel off layer. Both surfaces also may be adhesive if preferred. The strip of the gasket has a width greater than the spacing between the two rows of bolts 17 so that the bolts pass through the panel at the gasket.

A similar lap joint is provided along the bottom edge of the top row of panels for connection to the second row. All such lap joints include the bolt rows and the gasket as forth.

It will be noted from FIG. 1 that the vertical lap joint 16B are angularly offset from the vertical lap joints 16C of the second row with the lap joints 16D of the third row being again aligned with the lap joint 16B. The amount of offset is equal to one third of the length of the panels and the posts are arranged again angularly offset from the lap joints and spaced from the lap joints by one third of the length of the panels so that the posts are arranged for connection to the panel at a position spaced from the lap joints.

Figure 6:
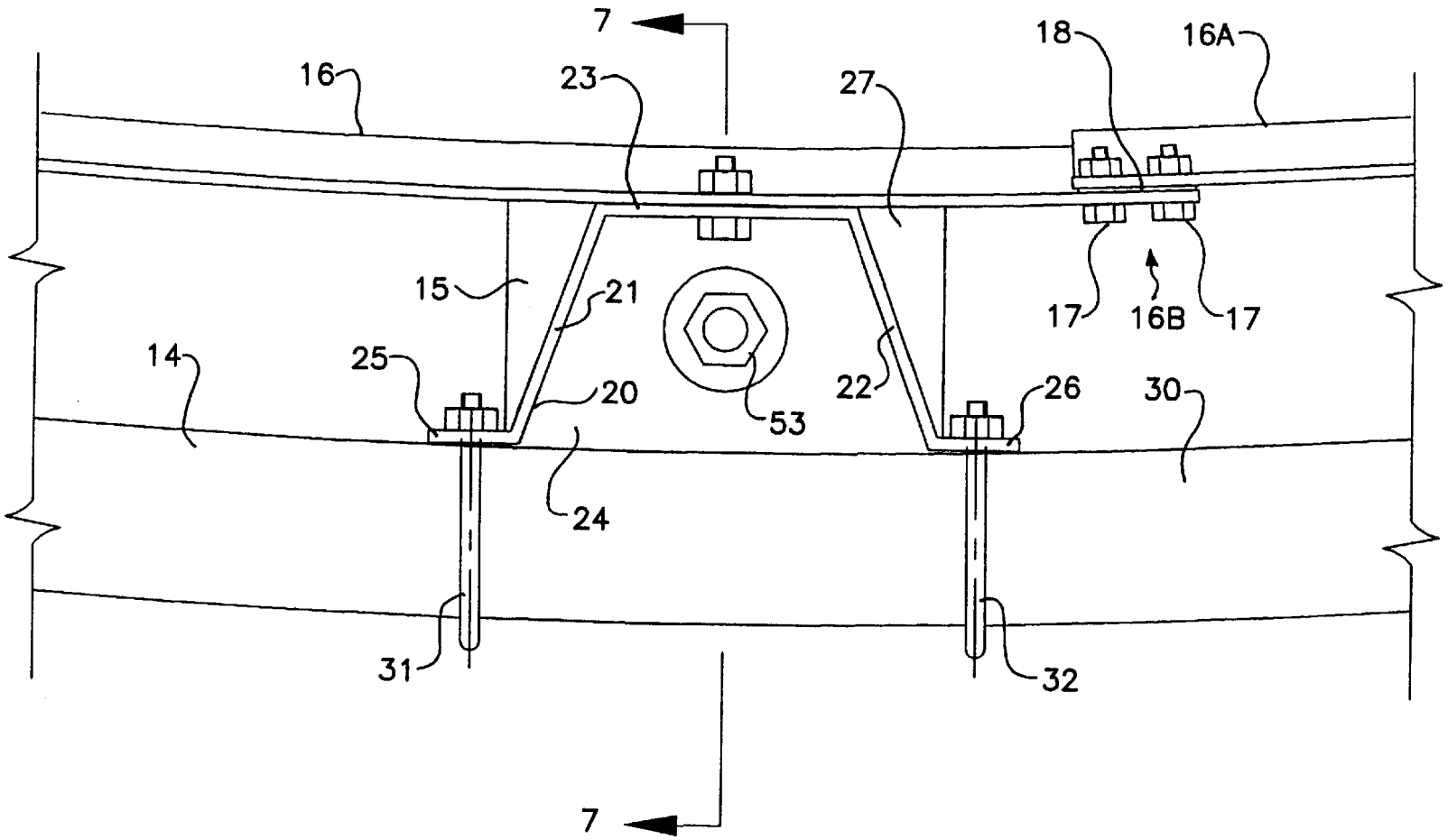
FIG. 6 is a top plan view of one post of the container of FIG. 1.
Figure 7:
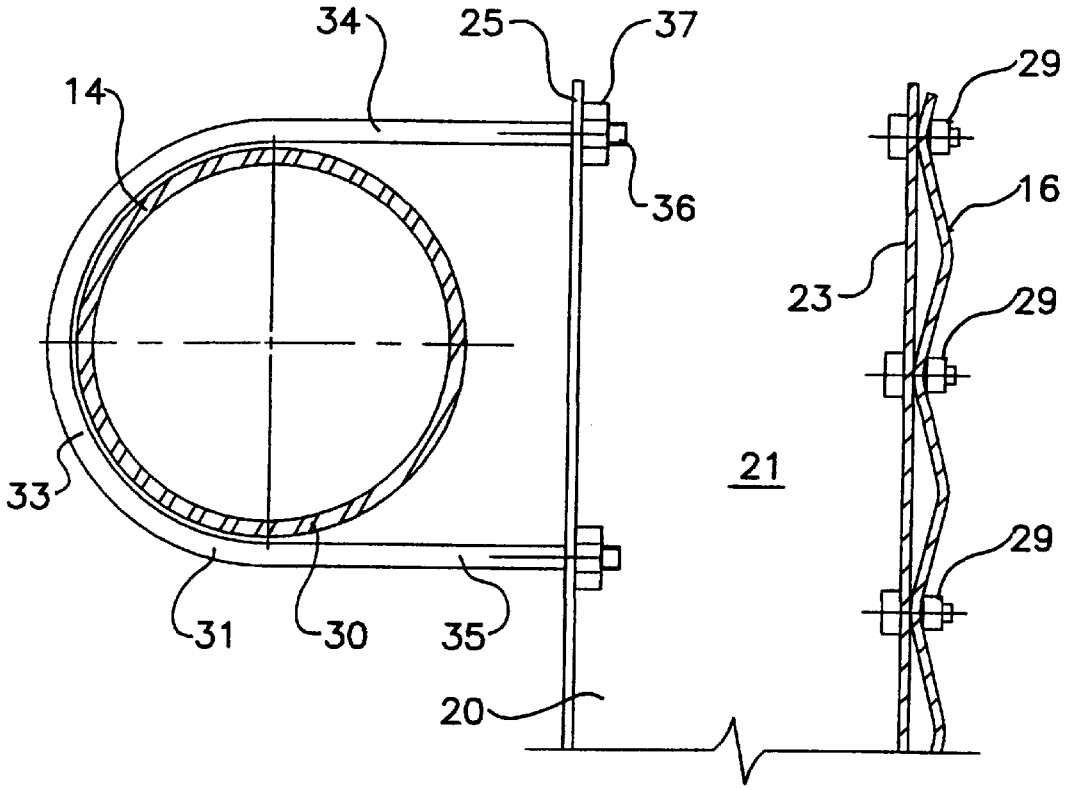
FIG. 7 is a cross sectional view along the lines 7—7 of FIG. 6.

The shape of the post is shown in FIGS. 6 and 7. Thus each post comprises a channel member 20 defined by side walls 21 and 22 and a rear web 23 connecting the side walls. The side walls are angled outwardly so that an open face 24 of the channel is wider than the rear web 23. Two flanges 25 and 26 connect to the front edge of the respective side wall with the flanges lying in a plane parallel to the rear web 23 and spaced forwardly therefrom.

The post further includes a flat horizontal base plate 27 welded to the bottom edges of the members defining the post so as to be rigidly attached thereto. The post can be formed in two sections one above the other interconnected by a bolted connection plate 28. The rear web 23 is bolted to the panels 16 by a row of bolts 29 which pass through those portions of the panel 16 which closely approach the rear web 23, depending upon a location of the corrugations of the panel.

The hoop member 14 is in the form of a tubular member formed from a suitable pipe which is curved to follow the curvature of the top edge 13. The pipe is formed in section which are bolted together by connector pieces inserted into the pipe (not shown). The pipe sections 30 of the hoop member 14 are attached across the open face of each of the posts thus contacting each of the flanges 25 and 26. The pipe sections are clamped to the posts at the flanges 25 and 26 by a pair of hoop clamps 31 and 32 each formed in U shape with a curved base portion 33 wrapped around the outside of the pipe section 30 and two legs 34 and 35 each of which is attached to the respective flange by a threaded section 36 and a nut 37

Thus the hoop member 14 attaches to each of the posts and provides structural rigidity for the top edge of the structure.

Figure 2:
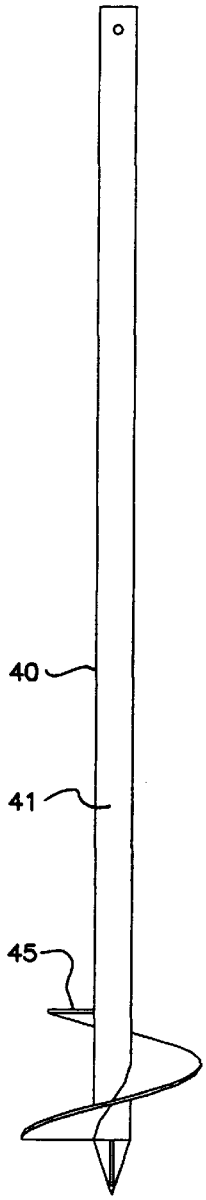
FIG. 2 is a side elevational view of a first portion of the ground anchor of the container of FIG. 1.
Figure 3:
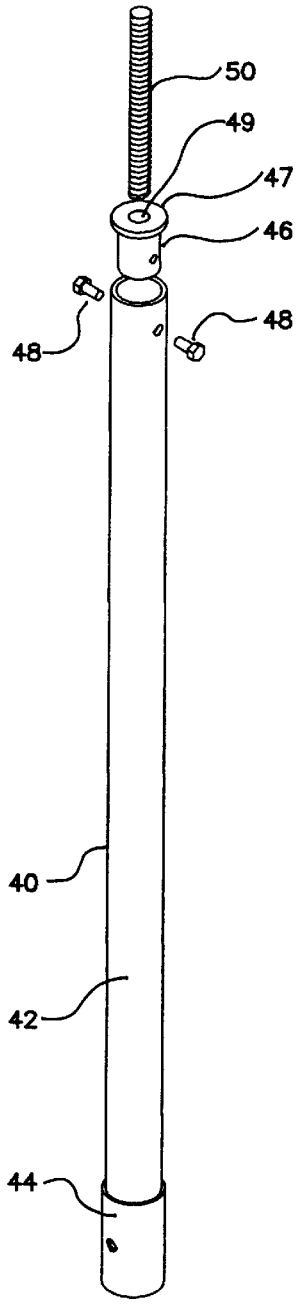
FIG. 3 is an isometric view of a second portion of the ground anchor of the container of FIG. 1.
Figure 4:
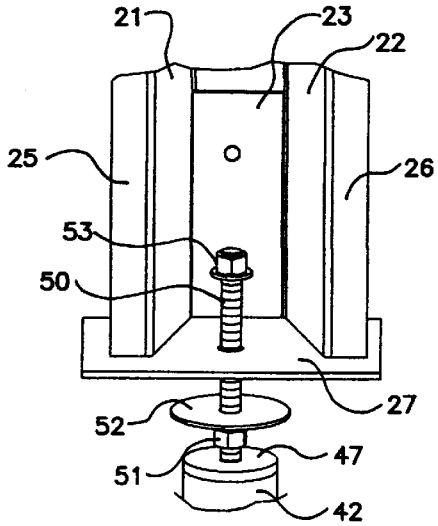
FIG. 4 is an isometric view showing the connection between the ground anchor and the bottom of the vertical posts of the container of FIG. 1.

The container further comprises a plurality of ground support anchors 40 each associated with a respective one of the posts. Each ground anchor includes a first shaft portion 41 shown in FIG. 2, and a second portion 42 shown in FIG. 3. These are connected by a collar 44 which connects the bottom end of the portion 42 to the top end of the portion 41. At the bottom end of the portion 41 is welded a helical flight section 45. The first portion 41 of the anchor can therefore be driven into the ground by rotation of that portion thus screwing the flight 45 into the ground until that portion is fully within the ground. The second portion is then attached to top end of the first portion and the rotation is continued until the second portion is also taken up into the ground thus taking the anchor to a depth of the order of eight feet.

At the top end of the portion 42 is provided an insert member 46 which has a cylindrical insert body which engages into the sleeve section defining the upper portion 42. A top cap 47 sits on the top end of the sleeve defining the portion 42. The top cap 46 is held in place by bolts 48. The top cap has a threaded hole 49 extending vertically through it for receiving a threaded post 50.

The bottom plate 27 is supported on the threaded post 50 by a nut 51 and a washer 52 and is clamped into place by a top nut 53. The height of the plate 27 relative to the top end of the ground anchor 40 can therefore be adjusted by adjustment of the nuts 51 and 53.

In assembly of the structure, therefore, the ground anchors 40 are arranged in a circle defining the periphery of the wall and are inserted into place on the ground. These ground anchors are approximately levelled so that each has a portion of the threaded rod 50 lying in a common horizontal plane to define the bottom of the container.

With the anchors in place the posts are attached onto the top of the ground anchor so as to stand vertically upwardly therefrom and the hoop member 14 is located at the top of the post so as to form a cylindrical frame work for the container. With the frame work in place, the panels are bolted together and bolted to the posts to complete the outside structure of the container.

In order to provide sufficient structural strength, the lap joints between the lower panels may include more than two rows of bolts so as to accommodate hoop stress in the wall structure.

The use of the ground anchor directly attached to the posts avoid the necessity for the laying of a concrete base. The ground anchors can be removed and the whole structure disassembled for reassembly at another location should this become necessary.

Figure 5:
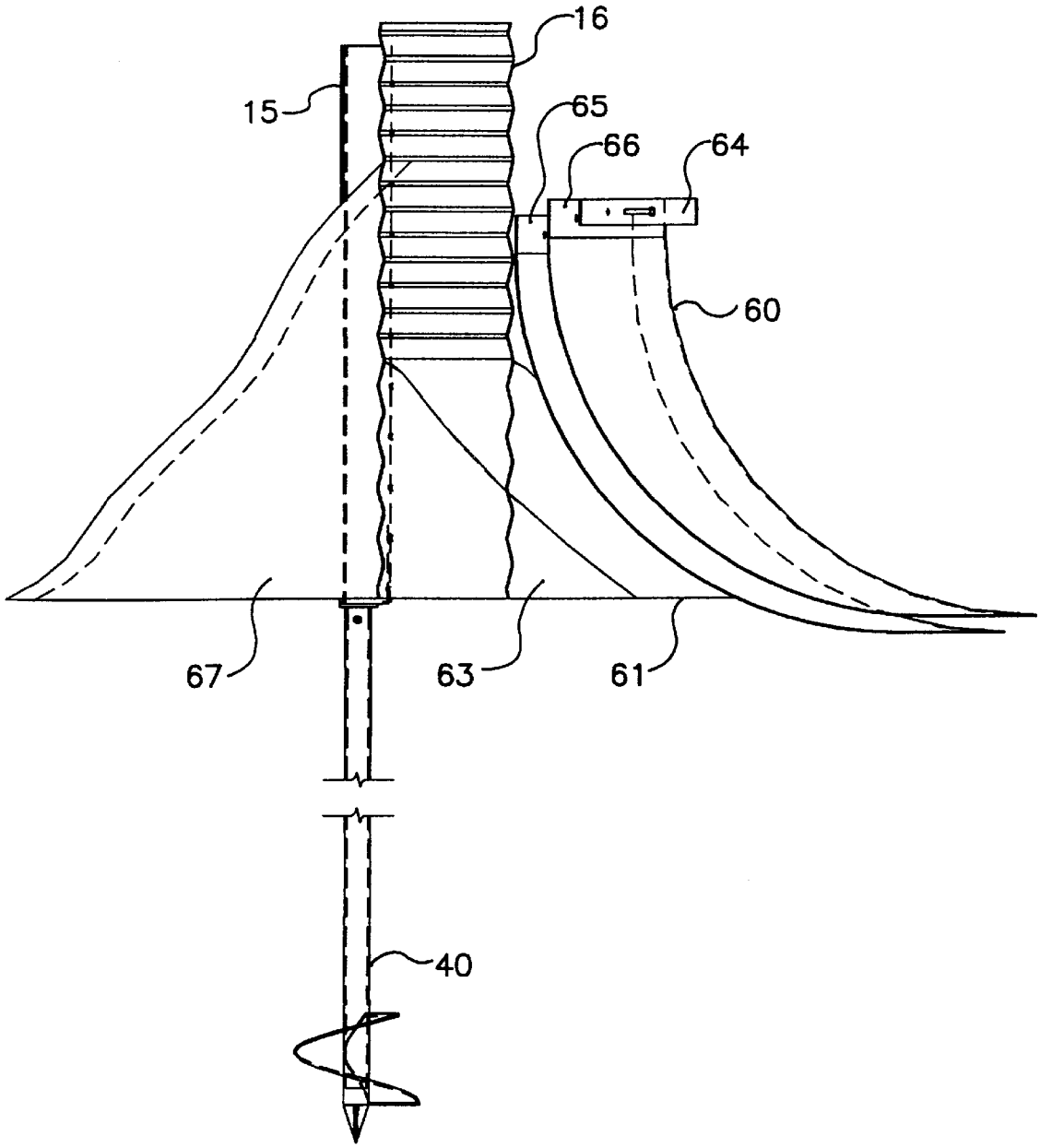
FIG. 5 is a vertical cross sectional view partly exploded of the ground anchor and lower portion of the wall of the container of FIG. 1.

In FIG. 5 is shown a liner assembly 60 which is laid over the ground surface 61 in the area inside the wall. Before applying the liner, a triangular curb of earth or similar film material is applied at 63 between the ground surface and a lower part of the wall. Thus the liner is laid across the ground, over the curb and is attached to the wall by a strap 64 engaged around a top of the liner and bolted to the wall. Suitable sealing by way of a gasket or sealant is applied between the liner and the wall. The liner can be formed in two layers 65 and 66 for increased protection against leakage. The liner is formed of a conventional liner material.

A back fill of earth or similar film material 67 is applied on the outside of the wall and over the connection between the anchors and the posts.

Figure 8:
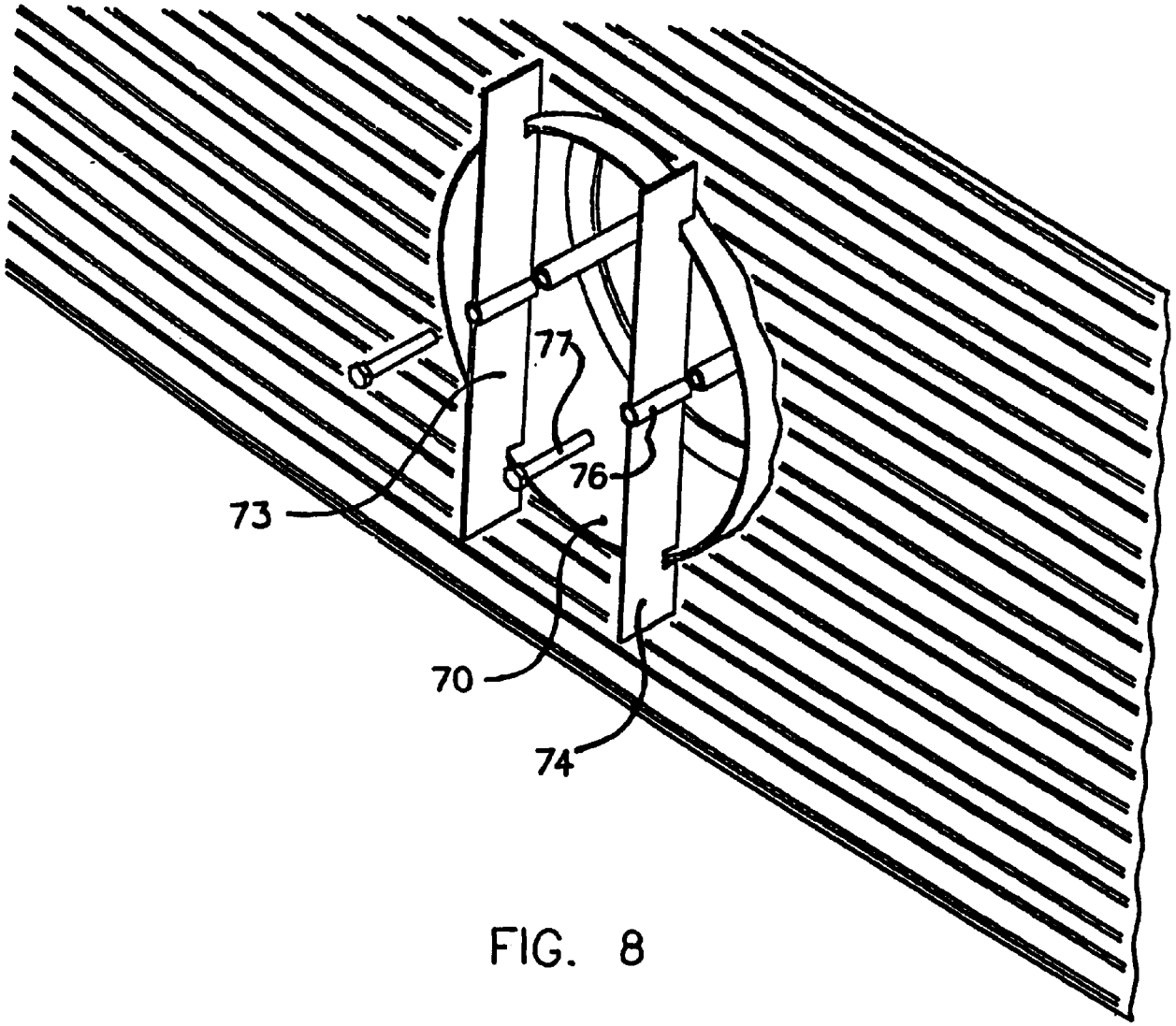
FIG. 8 is an isometric view of one wall panel containing a manhole for access into the interior of the container.
Figure 9:
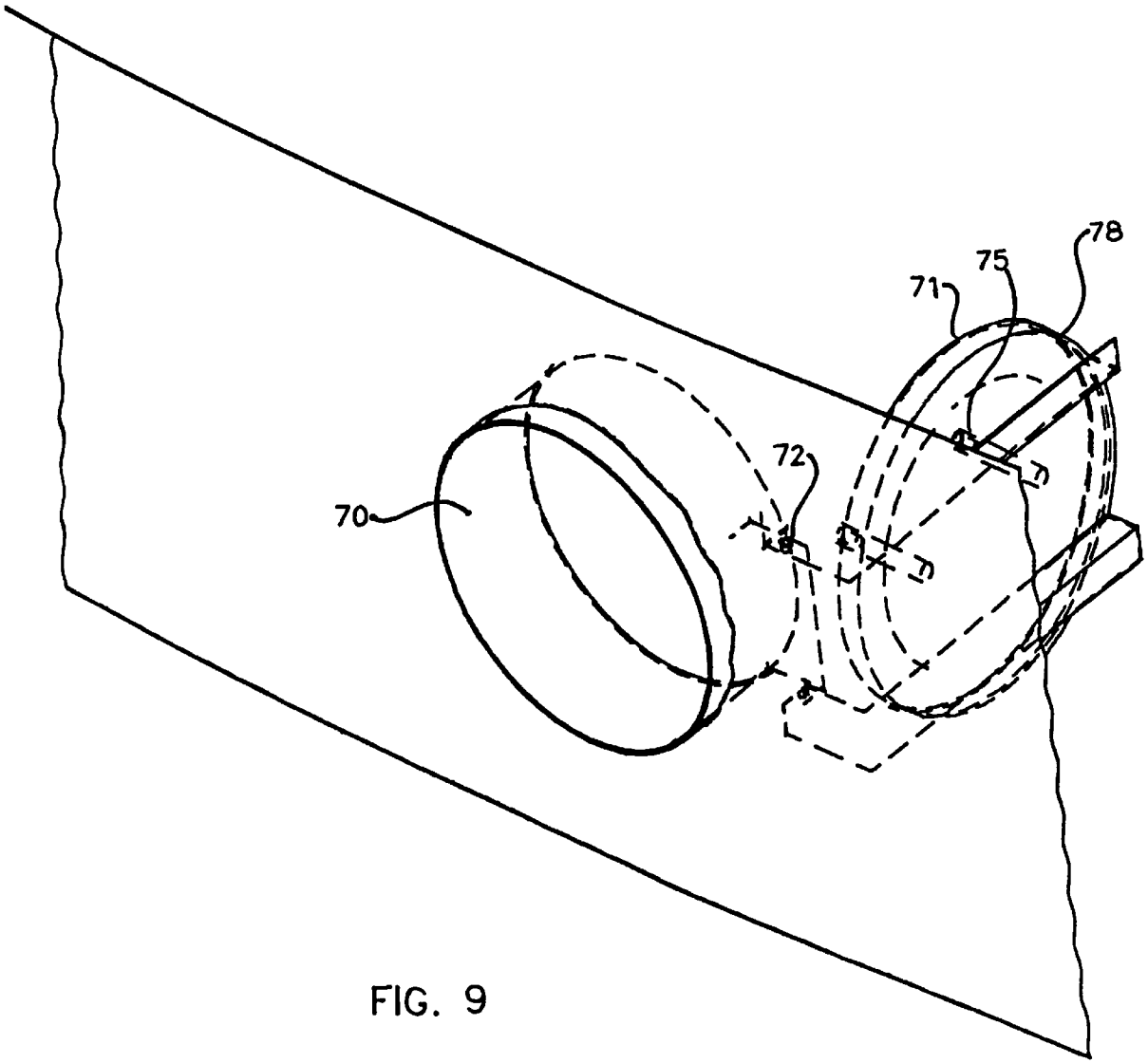
FIG. 9 is an isometric view showing in phantom a cover for the manhole opening of FIG. 8.

In FIGS. 8 and 9 is shown a manhole opening in one panel to allow access through the wall for service. The manhole comprises a cylindrical mounting flange 70 which is welded to the wall so as to project inwardly and outwardly therefrom. A hinged door 71 is mounted on hinges 72 on the flange 70 and can be clamped in a closed position against the flange by a pair of mounting plates 73 and 74 mounted on the flange on the opposite side to the door. The door carries attachment tubes 75 which co-operate with the tubes 76 carried by the mounting plates allowing a bolt 77 to pass through the tube thus clamping the door against one face of the flange 70 while the plates 73 and 74 are clamped against the other face of the flange 70 to ensure a safe closure of the door. The door has a peripheral flange 78 which engages outside the flange 70.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A liquid storage container comprising:

a cylindrical wall formed from a plurality of connected panels to define a generally horizontal top edge and a generally horizontal bottom edge surrounding an area of ground surface inside the wall;

a plurality of vertical posts connected to the wall at spaced positions around the wall;

a plurality of ground anchors each having a vertical shaft and a helical flight on the shaft, the shaft and the flight being arranged to be screwed into the ground, each anchor being connected at its upper end to a respective one of the posts;

and an impermeable liner lying over the area of ground surface inside the wall and having a skirt portion attached to the wall.

2. The container according to claim 1 wherein the wall is formed from corrugated steel panels bolted together and bolted to the posts.

3. The container according to claim 1 wherein the skirt portion is attached to the wall by an adhesive sealant material at a position on the wall spaced upwardly from the bottom edge.

4. The container according to claim 1 wherein there is provided an attachment band at the upper edge of the skirt portion and bolted to the wall.

5. The container according to claim 1 wherein each post has a horizontal plate at the bottom end thereof which is attached to the shaft of the ground anchor.

6. The container according to claim 5 wherein the ground anchor includes a screw threaded portion for screw height adjustment of the plate.

7. The container according to claim 1 wherein there is provided a reinforcing hoop member connecting the posts at a position adjacent the top edge of the wall.

8. The container according to claim 1 wherein there is provided a reinforcing hoop member comprises a tubular member which is attached to each of the posts by a pair of clamps.

9. The container according to claim 1 wherein the posts each comprise a channel member having an open face facing outwardly of the wall and an inner face opposite to the open face which is bolted to the wall.

* * * * *